United States Patent [19]

Pansini

[11] 3,961,393

[45] June 8, 1976

[54] SWIMMING POOL CLEANING APPARATUS

[76] Inventor: Andrew L. Pansini, 180 Los Cerros Drive, Greenbrae, Calif. 94904

[22] Filed: July 23, 1975

[21] Appl. No.: 598,245

Related U.S. Application Data

[63] Continuation-in-part of Ser. No. 516,747, Oct. 21, 1974, abandoned.

[52] U.S. Cl. ..... 15/1.7

[51] Int. Cl.[2] ..... E04H 3/20

[58] Field of Search ..... 15/1.7, 408, 409

[56] References Cited

UNITED STATES PATENTS 3,444,575 5/1969 Martin ..... 15/1.7

*Primary Examiner*—Edward L. Roberts

*Attorney, Agent, or Firm*—Naylor, Neal & Uilkema

[57] ABSTRACT

A wheel supported pool cleaner which picks up floor debris from the pool and induces it to move upwardly into a collector by an improved vortex-forming water jet action system.

2 Claims, 4 Drawing Figures

SWIMMING POOL CLEANING APPARATUS

This application is a continuation-in-part of my copending application Ser. No. 516,747 filed Oct. 21, 1974, now abandoned, for SWIMMING POOL CLEANING APPARATUS.

The subject invention constitutes an improvement over the pool cleaner described in Martin U.S. Pat. No. 3,444,575. In the pool cleaner of Martin U.S. Pat. No. 3,444,575, water jets are employed to create an upwardly ascending vortex action through the use of vertically offset multiple jet stages. By eliminating the jet stages save for the one annular stage at the immediate entrance to the conduit for the collector and by disposing the jets of the remaining stage so that they are directed to have substantially greater vertical components of movement than horizontal components, I am enabled to obtain an improved vortex-pickup action.

The objects and advantages of the invention will be apparent from the following description taken in conjunction with the drawing forming part of this specification, and in which.

Figure 1:
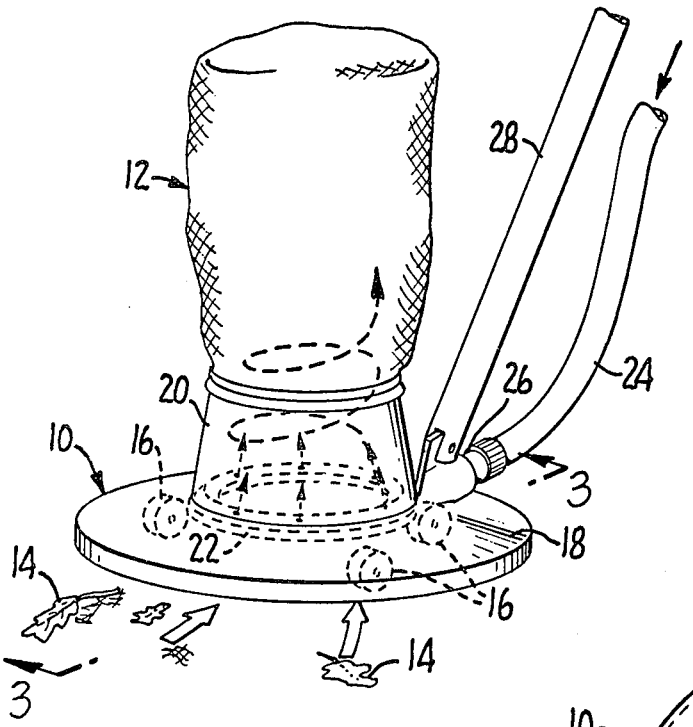
FIG. 1 is a view in perspective of the pool cleaning apparatus embodying the invention.
Figure 2:
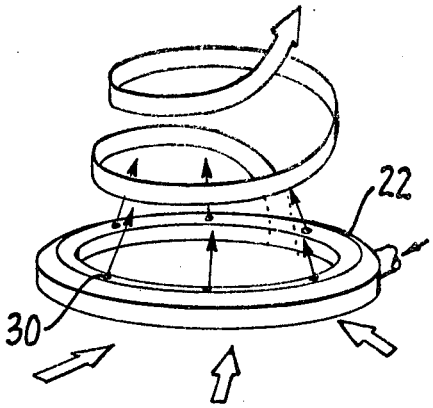
FIG. 2 is a view in perspective of the vortex-forming water-discharge ring of the apparatus, the flow of water under pressure being illustrated by the black flow arrows and induced flow of water being shown by the white flow arrows.
Figure 4:
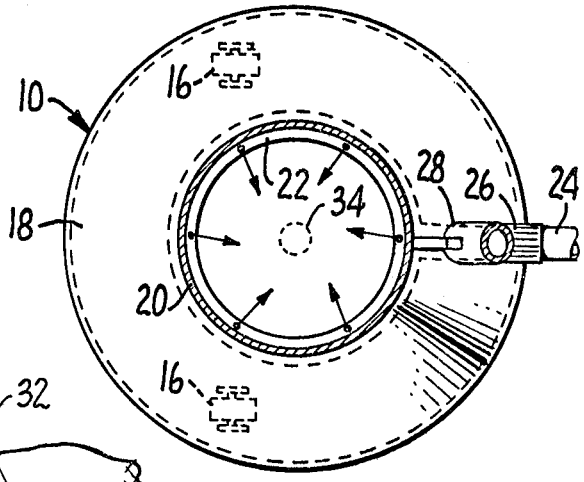
FIG. 4 is a view in reduced size taken along lines 4—4 of FIG. 3.
Figure 3:
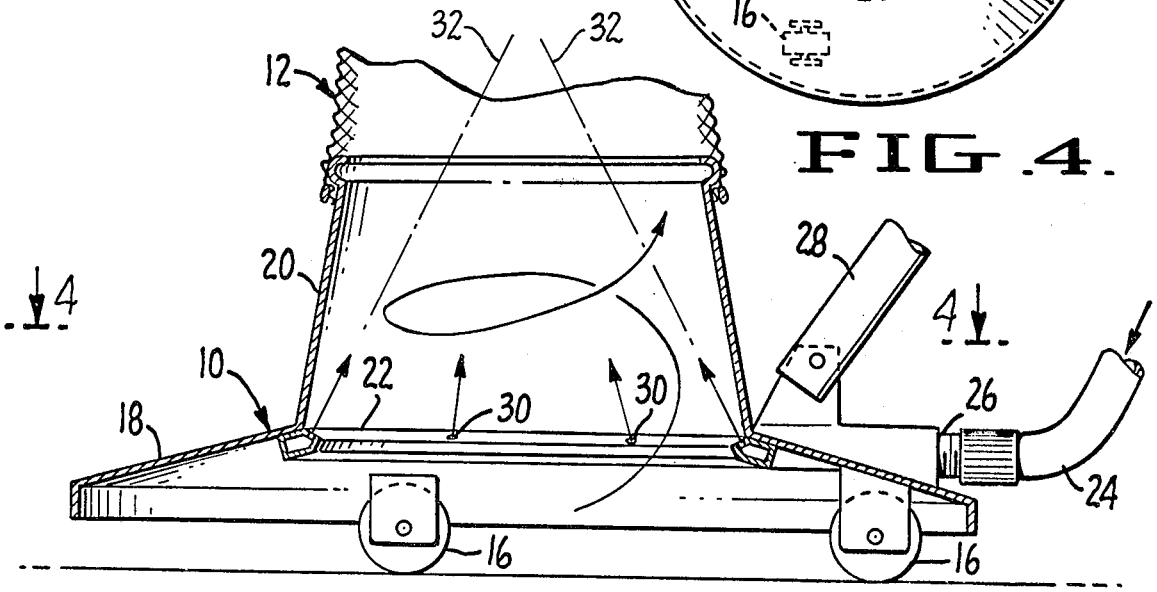
FIG. 3 is an enlarged view in section taken along lines 3—3 of FIG. 1.

With reference to the drawing, the apparatus comprises a housing 10 and a filter bag 12 serving as a collector for pool debris such as 14. The housing 10 is supported by wheels 16 and comprises an annular flange or skirt 18 and an open-ended tubular member or conduit 20. The housing 10 further comprises a water discharge ring 22 to which a water supply hose 24 may be attached, as at 26. Housing 20 may also have attached thereto a handle 28.

The ring 22 is provided with a plurality of equally spaced water discharge orifices 30 which are adapted to direct jets of water along alike paths 32 which are projected above the open upper end of conduit 20 into tangential relation with the small dotted line circle 34 which is located centrally above the open upper end of conduit 20. The projections of the jets are therefore in a spiralled pattern.

With the jet orifices 30 so arranged, the resulting apparatus has a stronger and more efficient dirt pickup vortex formation than has been hitherto obtained with cleaning devices of this type insofar as I am aware.

What is claimed is:

1. A pool cleaner comprising a housing having an upper open-ended conduit part and a lower flange part, wheels carried by the flange part to space the latter from a pool floor, a water delivery ring disposed near the lower end of the conduit part, a number of discharge ports in said ring, said ports being uniformly oriented to project jets of water in alike paths extending inwardly and upwardly toward each other and up above the upper end of the conduit part in a spiralled pattern whereby there is induced within the pool water within the conduit part an upwardly ascending, swirling current of water flow, and a water inlet conduit connected to the delivery ring.

2. A pool cleaner comprising a housing having an upper open-ended conduit part and a lower flange part, wheels carried by the flange part to space the latter from a pool floor, water supply means for the pool cleaner consisting of a water delivery ring and a water inlet conduit connected to the delivery ring, said delivery ring being disposed near the lower end of the conduit part, a number of discharge ports in said ring, said ports being uniformly oriented to project jets of water in alike paths extending inwardly and upwardly toward each other and up above the upper end of the conduit part in a spiralled pattern whereby there is induced within the pool water within the conduit part an upwardly ascending, swirling current of water flow.

* * * * *